US007403159B2

(12) United States Patent
Gooshchin

(10) Patent No.: US 7,403,159 B2
(45) Date of Patent: Jul. 22, 2008

(54) MICROSTRIP ANTENNA HAVING A HEXAGONAL PATCH AND A METHOD OF RADIATING ELECTROMAGNETIC ENERGY OVER A WIDE PREDETERMINED FREQUENCY RANGE

(76) Inventor: Dmitry Gooshchin, 39/11 Rubinshtein Street, Jaffo Daled, Tel-Aviv (IL) 68212

( * ) Notice: Subject to any disclaimer, the term of this patent is extended or adjusted under 35 U.S.C. 154(b) by 17 days.

(21) Appl. No.: 11/429,126

(22) Filed: May 8, 2006

(65) Prior Publication Data

US 2007/0257843 A1 Nov. 8, 2007

(51) Int. Cl.
*H01Q 1/38* (2006.01)

(52) U.S. Cl. ..... 343/700 MS; 343/700 MS; 343/770

(58) Field of Classification Search ..... 343/700 MS, 343/767, 770

See application file for complete search history.

(56) References Cited

U.S. PATENT DOCUMENTS 5,510,803 A * 4/1996 Ishizaka et al. ..... 343/700 MS
5,903,239 A * 5/1999 Takahashi et al. ..... 343/700 MS
6,664,926 B1 12/2003 Zinanti et al.
7,015,868 B2 3/2006 Puente Baliarde et al.
2001/0020920 A1* 9/2001 Shigihara ..... 343/732
2005/0116862 A1* 6/2005 du Toit ..... 343/700 MS
2006/0170594 A1* 8/2006 Cheng ..... 343/700 MS

* cited by examiner

*Primary Examiner*—Trinh Vo Dinh
*Assistant Examiner*—Dieu Hien T Duong

(57) ABSTRACT

An electrically conductive hexagonal patch element for a patch antenna. The hexagonal patch element comprising a hexagonal shape with a first angle and a second angle opposite the first angle, a third angle and a fourth angle opposite the third angle, a fifth angle and a sixth angle opposite the fifth angle, the first, third, and fifth angles each measuring approximately 150 degrees and the second, forth, and sixth angles each measuring approximately 90 degrees, wherein the first angle is positioned in between the fourth angle and the sixth angle.

24 Claims, 12 Drawing Sheets

MICROSTRIP ANTENNA HAVING A HEXAGONAL PATCH AND A METHOD OF RADIATING ELECTROMAGNETIC ENERGY OVER A WIDE PREDETERMINED FREQUENCY RANGE

FIELD AND BACKGROUND OF THE INVENTION

The present invention relates to a microstrip antenna and, more particularly but not exclusively, to a microstrip antenna having a hexagonal patch.

In its simplest form, a microstrip patch antenna consists of a radiating patch positioned on a dielectric substrate which overlays a ground plane. Microstrip patch antennas have been used widely as microwave circuit elements such as transmission lines, filters, resonators, and antennas. The rapid miniaturization of complex electronic circuits has vastly increased the demand for small size antennas. Hand-held computers, aerospace applications, mobile telephones, pagers and other portable wireless equipment now comprise microstrip antennas. The desirability of microstrip antennas results from their structure, particularly in view of their compactness, conformability, aerodynamic structure and general ease of fabrication.

A microstrip antenna which is used as an extension for a microstrip transmission line radiates primarily due to the fringing electromagnetic fields between the patch edge and the ground plane. It is known that providing an antenna patch which overlays a thick dielectric substrate having a low dielectric constant improves the antenna performance since this provides better efficiency, larger bandwidth and better radiation. However, such a configuration leads to a larger antenna size. In order to design a compact microstrip patch antenna, higher dielectric constants have to be used, limiting the antenna performance to a narrower bandwidth. Another method to improve the antenna performance is to introduce parasitic elements of varying size above and/or below the driven element. The addition of parasitic elements stacked above and/or below the driven element to increase the bandwidth is less desirable in some cases because of the physical structure that is required.

A known factor that influences the performance of an antenna is the structural design of the patch. The commonly known patches are generally made of a conducting material such as copper or gold, which can be structured to form different shapes. Known shapes for the radiating patch are square, rectangular, circular, triangular, and elliptical shapes. U.S. Pat. No. 6,664,926, issued on Dec. 16, 2003, discloses a compact planar antenna wherein a radiating element in the shape of a right triangle is formed on a substrate. A ground plane may be positioned on one or both sides of the substrate. In one embodiment, the radiating elements are positioned on the substrate in groups of two or more in close proximity to one another. In another embodiment, the radiating elements are arranged in an array.

Another example of a microstrip antenna is disclosed in U.S. Pat. No. 7,015,868, issued on Mar. 21, 2006. This patent discloses an antenna in which the corresponding radiative element contains at least one multilevel structure formed by a set of similar geometric patch elements (polygons or polyhedrons) electromagnetically coupled and grouped such that each of the basic component elements can be identified in the structure of the antenna. The design is such that it provides two important advantages: the antenna may operate simultaneously in several frequencies, and/or its size can be substantially reduced.

However, both patents and other known structures for patches of microstrip antenna do not provide optimum geometrical structures that allow transmission at a wide range of frequencies, while maintaining a high antenna gain level.

There is thus a widely recognized need for a compact microstrip antenna having a patch with an optimum geometrical structure which is easy to fabricate and is devoid of the above limitations.

SUMMARY OF THE INVENTION

According to one aspect of the present invention there is provided an electrically conductive hexagonal patch element for a patch antenna. The hexagonal patch element comprising a convex hexagonal shape with a first angle and a second angle opposite the first angle, a third angle and a fourth angle opposite the third angle, a fifth angle and a sixth angle opposite the fifth angle, the first, third, and fifth angles each measuring approximately 150 degrees and the second, forth, and sixth angles each measuring approximately 90 degrees, wherein the first angle is positioned in between the fourth angle and the sixth angle.

Preferably, the sides of the hexagonal patch are approximately equal.

Preferably, the apexes of the angles are configured as at least one of the following shapes: a rounded angle, an elongated angle, an arched angle, a concave angle, and a truncated angle.

More preferably, an oblong slot is formed within the hexagonal patch element.

Preferably, the angles may be set with deviations not exceeding 5 percent.

According to another aspect of the present invention there is provided a microstrip antenna having at least one electrically conductive hexagonal patch element. The microstrip antenna comprising: a first dielectric substrate having an obverse and a reverse side, an electrically conductive ground plane adapted to be coupled to the reverse side, at least one electrically conductive hexagonal patch element adapted to be coupled to the obverse side of the first dielectric substrate, the electrically conductive hexagonal patch element having a convex hexagonal shape with a first angle and a second angle opposite the first angle, a third angle and a fourth angle opposite the third angle, a fifth angle and a sixth angle opposite the fifth angle, the first, third, and fifth angles each measuring approximately 150 degrees and the second, forth, and sixth angles each measuring approximately 90 degrees, wherein the first angle is positioned in between the fourth angle and the sixth angle, and a signal feed element.

Preferably, the sides of at least one electrically conductive hexagonal patch are approximately equal.

Preferably, the microstrip antenna of claim further includes a radio frequency power source coupled to the signal feed element for causing the antenna element to emit an electromagnetic radiation energy pattern.

Preferably, the apexes of the angles are configured as at least one of the following shapes: a rounded angle, an elongated angle, an arched angle, a concave angle, and a truncated angle.

More preferably, an oblong slot is formed within the at least one electrically conductive hexagonal patch.

Preferably, the angles may be set with deviations not exceeding 5 percent.

Preferably, the electrically conductive hexagonal patches element having a surface area equal to the outcome of a function of a transmitted radiation wavelength of the microstrip antenna, and a dielectric permeability of the first dielectric substrate to the radiation.

Preferably, the microstrip antenna further comprises a second dielectric substrate.

More preferably, the second dielectric substrate is positioned in between the first dielectric substrate and the electrically conductive ground plane, wherein a portion of the signal feed element is positioned in between the first and second dielectric substrates.

More preferably, the second dielectric substrate is coupled to the bottom of the electrically conductive ground plane, the electrically conductive ground plane having at least one aperture, wherein a portion of the signal feed element is positioned in between the second dielectric substrate and the electrically conductive ground plane.

Preferably, the signal feed element is directly connected to the electrically conductive hexagonal patch element.

More preferably, the direct connection is done via the second, forth, and sixth angles in case of direct polarization.

Preferably, the second angle is truncated to form an additional side, the additional side being parallel to the central transverse axis of the at least one electrically conductive hexagonal patch, the signal feed element is positioned parallelly to the additional side.

Preferably, the signal feed element is used to elevate the at least one electrically conductive hexagonal patch element.

Preferably, the at least one electrically conductive hexagonal patch element comprising at least two electrically conductive hexagonal patch elements, the microstrip antenna further comprising a patch connector, the patch connector configured to interconnect between the at least two electrically conductive hexagonal patch elements.

Preferably, the first dielectric substrate is fabricated of a material of at least one of the following group: a cured fiber reinforced resin epoxy glass fabric and Teflon fiber glass, IS 620, and Rogers material.

Preferably, the at least one electrically conductive hexagonal patch element is configured to be parallelly positioned proximal to the obverse side of the dielectric substrate.

Preferably, the signal feed element is adapted to be connected to a receiver.

Preferably, the signal feed element is adapted to be connected to a transmitter.

According to another aspect of the present invention there is provided a microstrip a method of radiating electromagnetic energy over a wide predetermined frequency range. The method comprising the steps of: feeding an antenna element with transmission signals, the antenna element comprising: a first dielectric substrate having an obverse and a reverse side, an electrically conductive ground plane adapted to be coupled to the reverse side, at least one electrically conductive hexagonal patch element adapted to be coupled to the obverse side of the first dielectric substrate, the electrically conductive hexagonal patch element having a convex hexagonal shape with a first angle and a second angle opposite the first angle, a third angle and a fourth angle opposite the third angle, a fifth angle and a sixth angle opposite the fifth angle, the first, third, and fifth angles each measuring approximately 150 degrees and the second, forth, and sixth angles each measuring approximately 90 degrees, wherein the first angle is positioned in between the fourth angle and the sixth angle, and a signal feed element; and connecting the signal feed element to a signal conveyor.

Preferably, the signal conveyor is a transmitter.

Preferably, the signal conveyor is a receiver.

Preferably, the electrically conductive hexagonal patch elements having a surface area equal to the outcome of a function of a transmitted radiation wavelength of the antenna element, and a dielectric permeability of the first dielectric substrate to the radiation.

Unless otherwise defined, all technical and scientific terms used herein have the same meaning as commonly understood by one of ordinary skill in the art to which this invention belongs. The materials, methods, and examples provided herein are illustrative only and are not intended to be limiting.

Implementation of the device and method of the present invention involves performing or completing certain selected tasks or steps manually, automatically, or a combination thereof.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 2D is a perspective view of an exemplary microstrip antenna having a hexagonal patch with rounded angles having an oblong slot formed therein.

DESCRIPTION OF THE PREFERRED EMBODIMENTS

Figure 1:
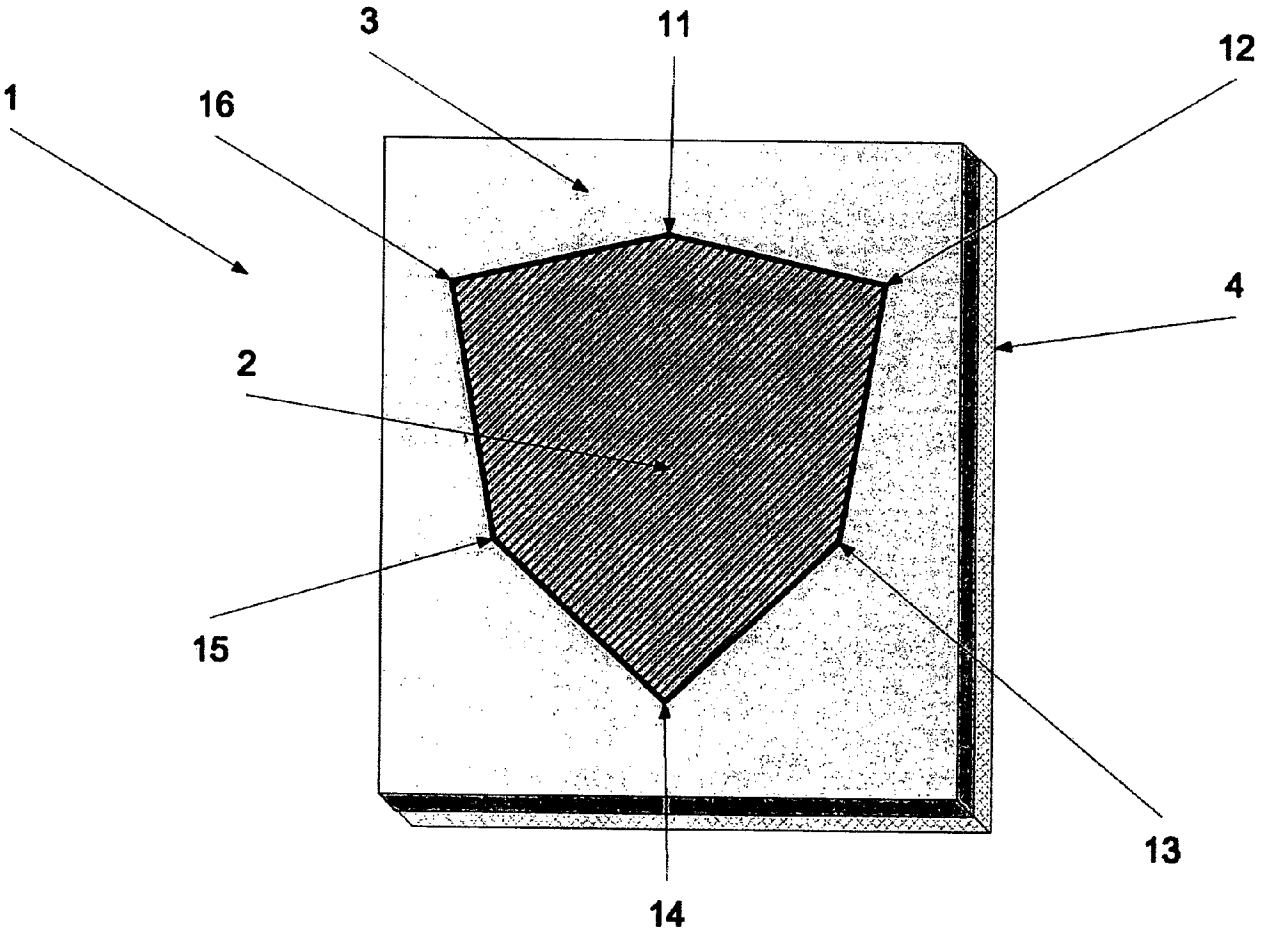
FIG. 1 is a perspective view of an exemplary microstrip antenna having a hexagonal patch, according to a preferred embodiment of the present invention.

The present embodiments comprise a microstrip antenna having one or more electrically conductive hexagonal patch elements and a method of radiating electromagnetic energy over a wide predetermined frequency range. The hexagonal patch elements of the microstrip antenna are designed to form a compact structure which is easy to fabricate. The structure of the hexagonal patch elements has been designed to enable high antenna gain while using the microstrip antenna for transmitting electromagnetic transmissions having a frequency from a wide bandwidth. Moreover, the structure of the hexagonal patch according to the present embodiments is designed to decrease the cross polarization radiation of the microstrip antenna.

The microstrip antenna is comprised of several components. The core of the microstrip antenna is a dielectric substrate. An electrically conductive ground plane is coupled to the bottom of the dielectric substrate. One or more electrically conductive hexagonal patch elements are parallelwise positioned in proximity to the upper side of the dielectric substrate. Each electrically conductive hexagonal patch has a convex hexagonal shape. Three angles of the convex hexagonal shape are each approximately right angles and the other angles are wide angles, each of approximately 150 degrees. Each right angle is positioned opposite a wide angle. Each wide angle is positioned in between two right angles. The microstrip antenna is coupled to a signal feed element which is used to feed the antenna with transmission signals.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1 which depicts an exemplary microstrip antenna 1 having a hexagonally structured patch 2 according to one embodiment of the present invention. The hexagonal patch 2 is positioned on the top side of a dielectric substrate 3. Preferably, the bottom side of the dielectric substrate 3 is coupled to an electrically conductive surface 4. The electrically conductive surface 4 has been retained for a reference or a ground plane surface.

As described above, microstrip antennas are used as microwave circuit elements such as transmission lines, filters, resonators, and antennas. The desirability of the microstrip antennas results from their structures, particularly in view of their compactness, conformability, and general ease of fabrication. However, commonly known disadvantages of known microstrip antennas are, *inter alia,* their narrow frequency bandwidth and their low efficiency factor, which results from low antenna gain.

In order to overcome the aforementioned disadvantages, the geometrical form of the hexagonal patch 2 has been chosen so as to maximize the efficiency factor while extending the frequency range. The patch 2 is configured as a generally convex hexagonal shape with a set of three wide angles and a set of three approximately right angles. Each one of the wide angles 11, 13, 15 measures approximately 150 degrees. Each one of the right angles 12, 14, 16 measures approximately 90 degrees. Each one of the wide angles 11, 13, 15 is positioned in between two of the right angles. Each wide angle 11, 13, 15 is positioned opposite a right angle 14, 16, 12, respectively. The complex geometrical form of the hexagonal patch 2 has been structured to optimize the functioning of the microstrip antenna 1. Preferably, the unique angular structure of the hexagonal patch 2 preferably give rise to the formation of an approximately equilateral hexagonal patch 2 having sides which are approximately equal.

Preferably, each one of the wide angles should be an angle of between 145.5 degrees and 154.5 degrees and each one of the right angles should be an angle of between 85.5 degrees and 94.5 degrees. The patch antenna can be made with deviations not exceeding 5% in one or more of the above angles. It should be noted that microstrip antenna with a hexagonal patch having angles with a 5 percent deviation from the aforedescribed optimal angular design yields results which are close to those of a patch having the precise angles detailed herein.

Figure 2A:
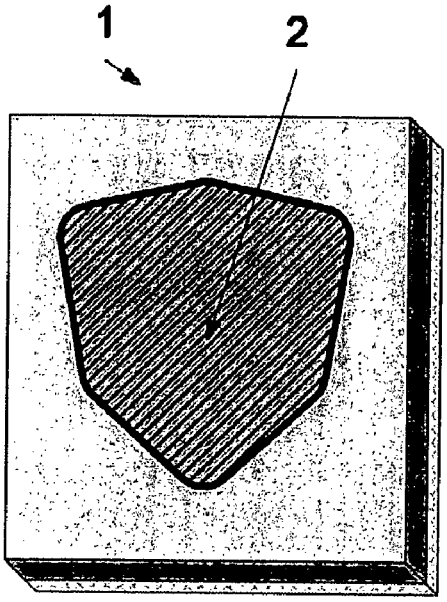
FIGS. 2A, 2B, 2C, and 2D are perspective views of exemplary microstrip antennas, each having a hexagonally structured patch with angles having differently shaped apexes.
Figure 2D:
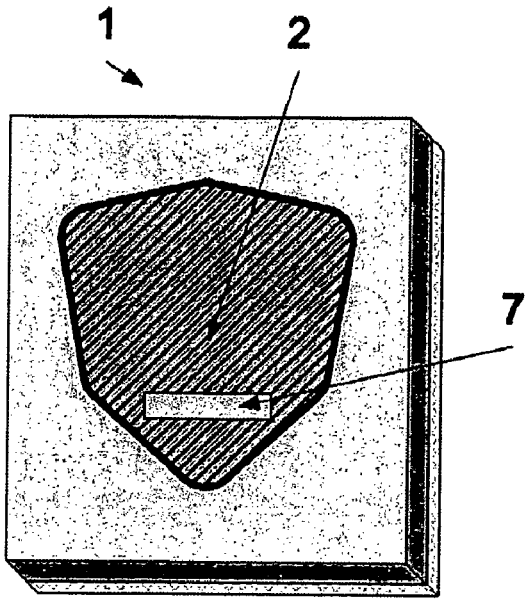
Figure 2B:
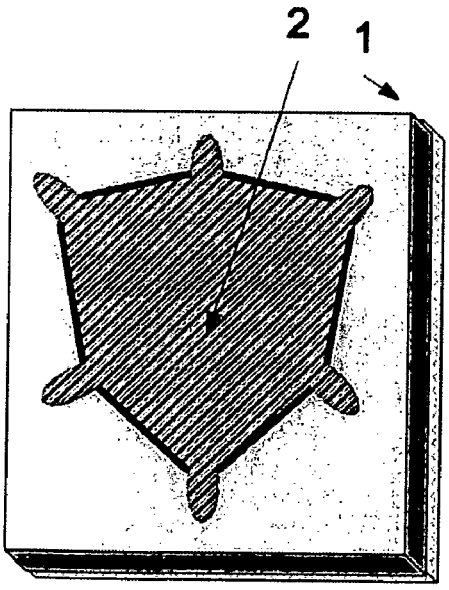
Figure 2C:
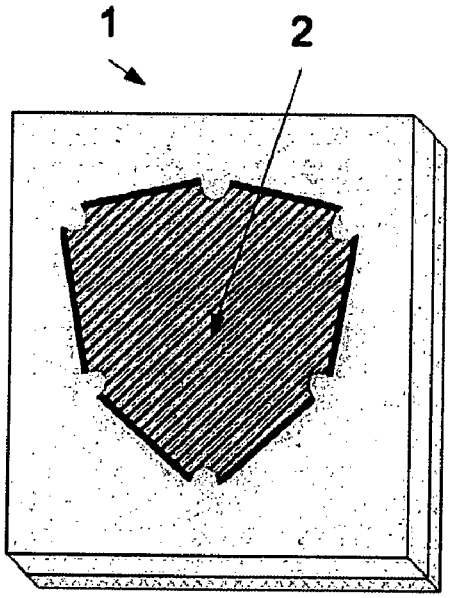

Reference is now made to FIGS. 2A, 2B, 2C and 2D which depict an exemplary microstrip antenna 1 having a hexagonally structured patch 2 with angles having differently shaped apexes. Parts that are the same as in FIG. 1 are given the same reference numerals and are not described again except as necessary for an understanding of the present issue. In the embodiment shown in FIG. 1, the hexagonally structured patch 2 is configured as having angles with sharpened apexes. However, it will be appreciated by persons skilled in the art that, if desired, a hexagonally structured patch having angles with apexes which are shaped differently. The apex of the angles may be shaped, for example, rounded, as depicted in FIG. 2A, elongated, as depicted in FIG. 2B, concave, as depicted in FIG. 2C, or shaped in any other manner as desired. FIG. 2D depicts a hexagonally structured patch having angles with rounded apexes and an oblong slot 7 formed therein. The oblong slot 7 may be formed with different width and length and may be positioned in different locations along the surface area of the hexagonally structured patch. The forming of an oblong slot 7 along a hexagonally structured patch having angles with rounded apexes, for example, improves the performance of the microstrip antenna 1 under various conditions.

Reference is now made, once again, to FIG. 1. The microstrip antenna 1 may be used to emit electromagnetic radiation having different wavelengths. The frequency of the transmitted electromagnetic radiation is affected by the surface area of the hexagonal patch 2 and by the relative dielectric permeability of the dielectric substrate 3 to the radiation. The relationship between the size of the hexagonal patch 2 and the wavelength of the transmitted radiation can be described by the following equation:

$$S \cong \left(\frac{\lambda_0}{2\sqrt{\varepsilon_r}}\right)^2 \cdot 1.2$$

where $S$ denotes the surface area of the hexagonal patch 2, $\lambda_0$ denotes the transmitted radiation wavelength, and $\in_r$ denotes the relative dielectric permeability of the dielectric substrate 3 to the radiation.

Since the wavelength $\lambda_0$ has an inverse relationship to the frequency of the transmissions, the frequency of the radiation of the microstrip antenna 1 can be described by the following equation:

$$\lambda = \frac{c}{f}$$

where f denotes the frequency, λ denotes the wavelength, as described above, and c denotes the speed of light in space.

As described above, in order to increase the antenna performance and to provide a better efficiency factor and a larger bandwidth, a dielectric substrate with a relatively low dielectric constant has to be used. Accordingly, the dielectric substrate 3 is preferably made of a partially cured, fiber-reinforced resin epoxy glass fabric, Teflon fiber glass, IS 620, Rogers material and others.

Preferably, the dielectric substrate has a thickness ranging between 0.5 mm and 2 mm and a dielectric constant ranging between of about 2 and about 10.

Preferably, when the dielectric substrate is fiber-reinforced resin epoxy glass the thickness is 0.8 mm and the dielectric constant is 4.5.

As commonly known, when the feed is conveyed to the microstrip antenna 1, fringing electromagnetic fields are formed in the gap between the hexagonal patch 2 and the electrically conductive surface 4. The dielectric substrate 3 is positioned in the gap. The fringing fields generate the transmitted electromagnetic waves.

Figure 3B:
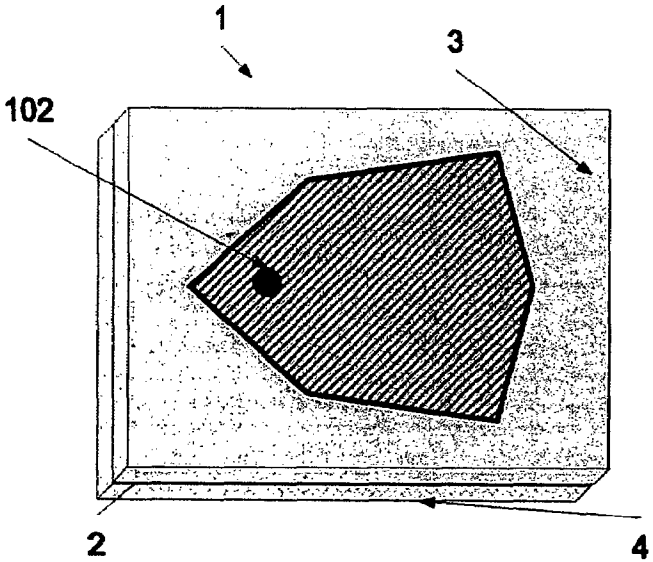
FIGS. 3A, 3B, 3C are perspective views of exemplary microstrip antennas, each having a hexagonal patch with a direct contacting connection, according to embodiments of the present invention.
Figure 3C:
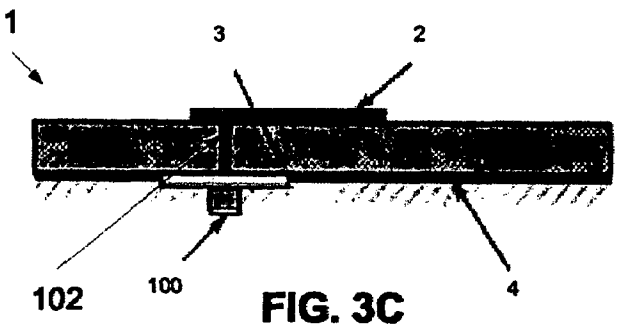
Figure 3A:
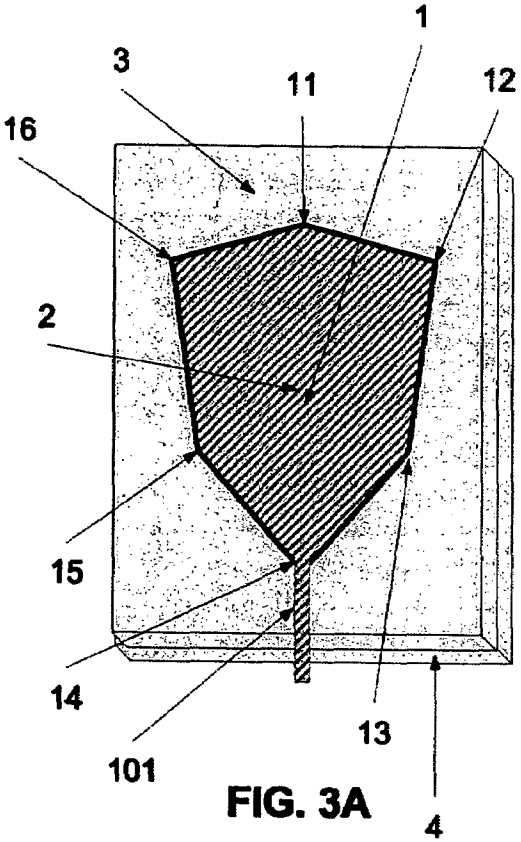

Reference is now made to FIGS. 3A, 3B and 3C which show exemplary embodiments of the present invention. The hexagonally structured patch 2, the dielectric substrate 3, and the electrically conductive surface 4 are similar to those shown in FIG. 1 above. However, these figures further depict direct contacting connections, described below, which are used to transfer signals to the microstrip antenna 1.

As with many other antennas the microstrip antenna 1 is used to transmit radio frequency (RF) or other electromagnetic waves. In use, the microstrip antenna 1 receives signals from an electronic circuit and generates electromagnetic radiation accordingly. The signals are received from one or more connections which are coupled to the body of the microstrip antenna 1, as described below. The signal feed may be transferred to the microstrip antenna 1 in a contacting manner, such as discussed with regard to FIGS. 3A-C or in a non-contacting manner, as discussed below with regard to FIGS. 4A-D.

In the embodiments of the present invention shown in FIGS. 3A-C, the signal feed is transferred to the microstrip antenna 1 via a direct contacting connection such as a microstrip line feed and a coaxial feed. FIG. 3A depicts a microstrip antenna 1 having an integrally formed microstrip line 101 which is used for connecting a signal feed to the microstrip antenna 1 via the hexagonally structured patch 2.

The integrally formed microstrip line 101 is preferably connected to any one of the angles of the patch 11, 12, 13, 14, 15, 16, however in case of a linear polarization the integrally formed microstrip line 101 is directly connected to one of the right angles of the patch 12, 14, 16.

FIGS. 3B and 3C show respective sectional perspective and external perspective views of a microstrip antenna 1 connected to a coaxial connector 100 positioned on the bottom side of the dielectric substrate 3. The coaxial connector 100 is connected to a conductor 102 which is used to conduct the feed to the hexagonal patch 2. Both FIGS. 3B and 3C depict a contact feeding method using a coaxial probe connection.

Reference is now made to FIGS. 4A, 4B, 4C and 4D, which show exemplary embodiments of the present invention. The hexagonally structured patch 2, the dielectric substrate 3, and the electrically conductive surface 4 are similar to those shown in FIG. 1 above. However, these figures further depict a non-direct connection which is used to transfer signals to the microstrip antenna 1.

Figure 4B:
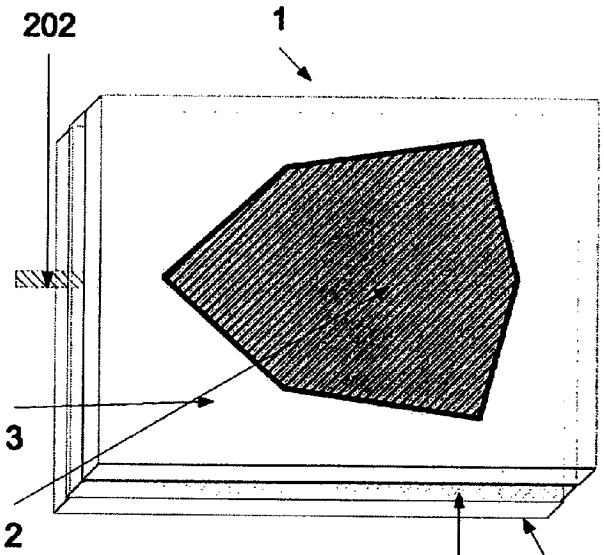
FIGS. 4A, 4B and 4C are perspective views of an exemplary microstrip antenna having a hexagonal patch with an indirect contacting connection, according to an embodiment of present invention.
Figure 4D:
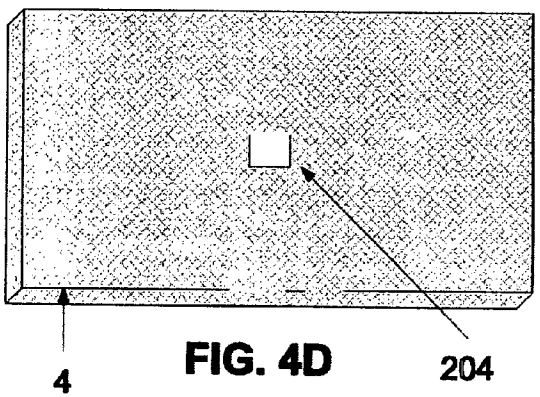
FIG. 4D is a perspective view of the exemplary dielectric substrate shown in FIG. 4B, the substrate having an aperture for coupling an indirect contacting connection, according to an embodiment of present invention.
Figure 4A:
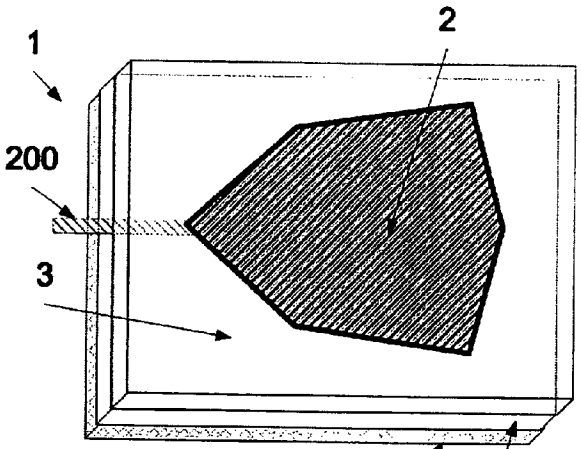

FIG. 4A depicts an embodiment which utilizes a non-contact coupling method which is known as proximity coupling. As depicted, the microstrip antenna 1 includes another dielectric substrate 201 positioned between the first dielectric substrate 3 and the electrically conductive surface 4. The dual dielectric substrate structure enables the positioning of a microstrip line 200 in-between the dielectric substrates 3 and 201, proximal to the electrically conductive surface 4 and the hexagonal patch 2. This configuration allows non-contact coupling, known as proximity coupling, between the microstrip line 200 and the patch 2.

FIG. 4B depicts another embodiment utilizing a non-contact coupling method which is known as an aperture coupling method. This structure is similar to that utilizing proximity coupling which is depicted in FIG. 4A as it also uses two substrates. However, the difference is that the electrically conductive surface 4 in FIG. 4B is positioned in between the two substrates 3 and 201. As depicted at reference number 204 of FIG. 4D, an aperture exists on the electrically conductive surface 4, preferably in the geometrical center thereof, to allow non-contact coupling between microstrip line 202 and patch 2 to take place via the aperture 4. Thus, in this embodiment, non-contact coupling, known as aperture coupling, is achieved between microstrip line 202 and patch 2.

Figure 4C:
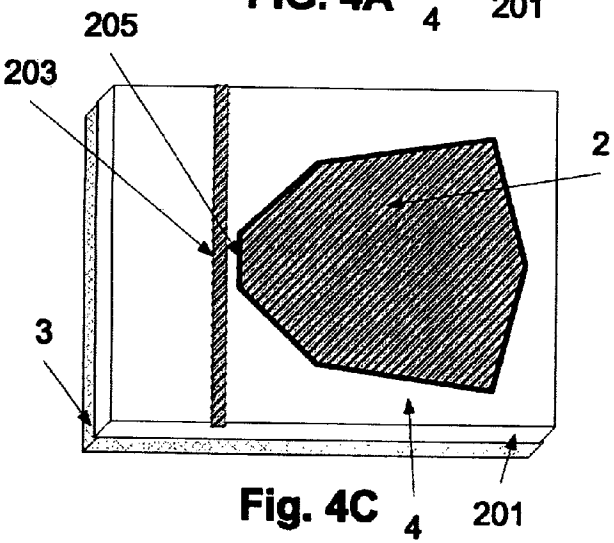

FIG. 4C depicts another embodiment utilizing a non-contact coupling method. This structure is similar to that utilizing proximity coupling which is depicted in FIG. 1 as it uses only the first dielectric substrate 3 and the electrically conductive surface 4. However, one difference is that one of the patch 2 angles has been truncated to form an additional side 205 which is preferably parallel to the central transverse axis of the microstrip antenna 1. Another difference is that a microstrip line 203 is FIG. 4C is positioned on the dielectric substrate 3, beside the patch 2 without making make a physical contact with it. Preferably, the microstrip line 203 is positioned in parallel to the additional side 205.

Figure 5:
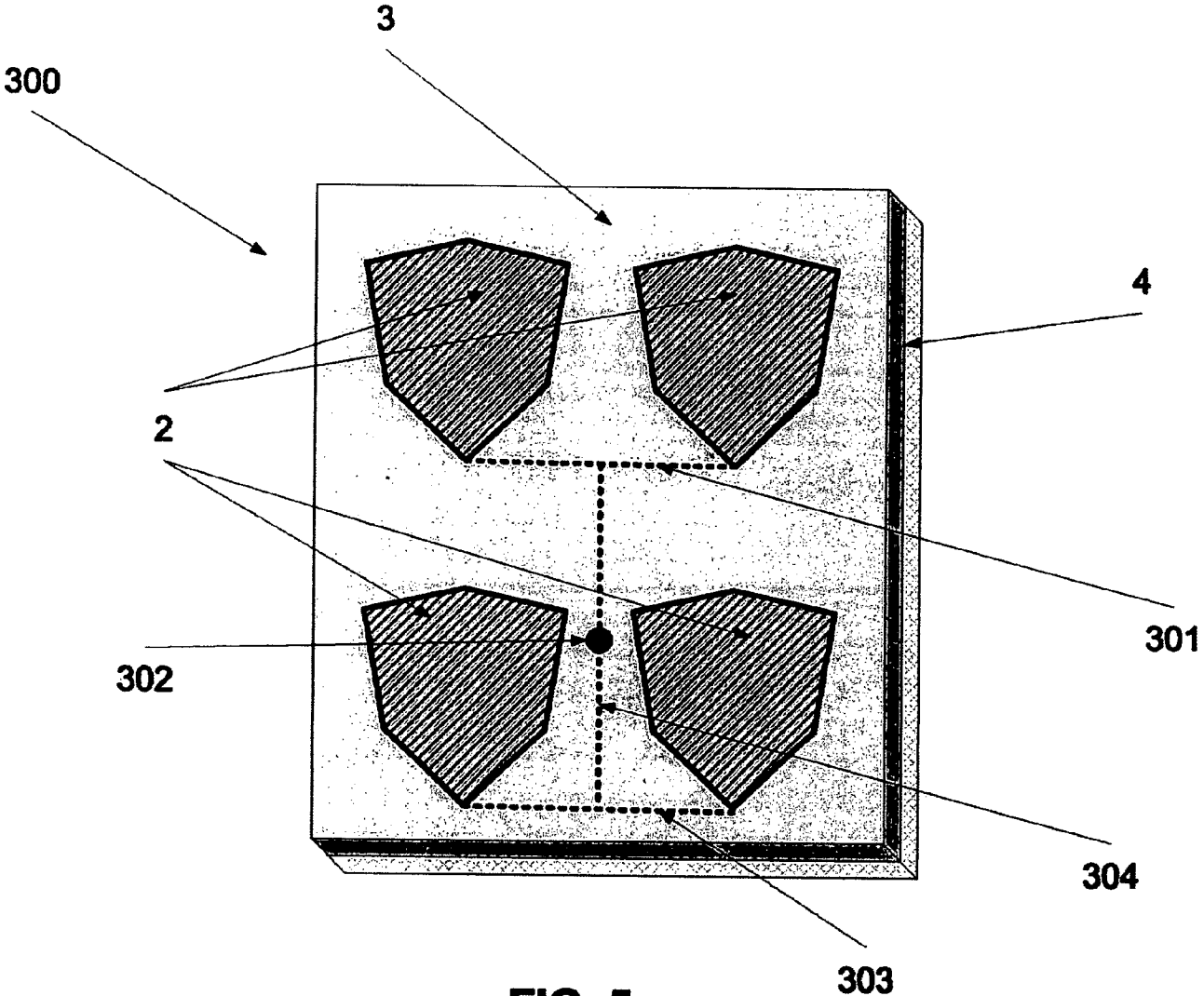
FIG. 5 is a perspective view of an exemplary microstrip antenna having a set of four hexagonal patch elements, according to another embodiment of present invention.

Reference is now made to FIG. 5 which depicts an exemplary microstrip antenna 300 that comprises a set of hexagonal patches 2 according to another exemplary embodiment of the present invention. Each one of the hexagonal patches 2, the dielectric substrate 3, and the electrically conductive surface 4 are as in FIG. 1 above. However, in the present embodiment, each the hexagonal patches are connected via a set of patch connection strips 301, 303 and 304 to improve the performance of the microstrip antenna 300.

This novel structure of the hexagonal patches 2 is used in microstrip antennas that comprise more than one patch. For example, FIG. 5 depicts a microstrip antenna 300 having a set of four hexagonal patches 2. The hexagonal patches are interconnected by patch connection strips 301, 303 and 304 which enable the transmission of signals from a signal feed to all the patches 2. Preferably, the patch connection strips 301, 303 and 304 are coupled to one or more external feeds that transmit signals via a connector 302. Preferably, the connector 302 is positioned in the geometrical center of the central patch connection strip 304.

In one embodiment of the present invention (not shown), the connector may be used to elevate the set of hexagonal patches so as to form an air gap between the set of hexagonal patches and the dielectric substrate which is coupled above the electrically conductive surface 4. Preferably, the gap is 5 mm high. Preferably, the microstrip antenna is hermetically sealed with a radio-transparent cover.

Preferably, the microstrip antenna is coupled to a number of passive elements or to additional layers of dielectric substrate which are used to enhance the radiation and its bandwidth.

Preferably, the microstrip antenna may be integrated into different structures. Other known ways of coupling different elements may be used to adjust the microstrip antenna 1 to achieve a linear polarization in one or more directions, circular polarization, and mixed polarization.

One advantage of the microstrip antenna 300 of FIG. 5, or of any other microstrip antenna having one or more hexagonal patches 2, is that it provides the ability to transmit RF waves in a wide range of frequencies while maintaining high gain levels.

Preferably, a microstrip antenna having a set of four hexagonal patches 300 according to the present embodiments is designed so as to maintain a high antenna gain level of approximately 14 dBi. The antenna gain reflects the ratio of the power required at the input of a hypothetical antenna having the same properties that radiates or receives equally in all directions (a known isotropic antenna) to the power supplied to the input of the microstrip antenna of the present invention. The measured supplied power reflects the power required to produce, in a given direction, the same field strength at the same distance. The antenna gain refers to the direction of maximum radiation of the antenna.

The microstrip antenna 300 maintains a gain level of at least 14 dBi at a range of frequencies between 2.9 GHz and 3.8 GHz. The high antenna gain level reflects a high efficiency factor which is maintained through a wide range of frequencies. The ratio between the mean of the transmission frequency (3.35 GHz) and the range of frequencies in which the antenna gain is high (3.8 GHz−2.9 GHz=0.9 GHz) is 26.8%, as calculated by the following equation:

$$\frac{\Delta f}{f_{mean}} = \frac{f_{\max} - f_{\min}}{(f_{\max} + f_{\min}) \cdot 0.5} \cdot 100 = \frac{0.9}{3.35} \cdot 100 = 26.8\%$$

where $f_{max}$ denotes the maximum efficient transmission frequency, $f_{min}$ denotes the minimum efficient transmission frequency, and $f_{mean}$ denotes the mean of the range of the efficient transmission frequencies. It should be noted that a microstrip antenna that comprises a set of more than four hexagonal patches may achieve an extended range of frequencies. Preferably, the hexagonal patches are integrated into an active antenna array.

Figure 8:
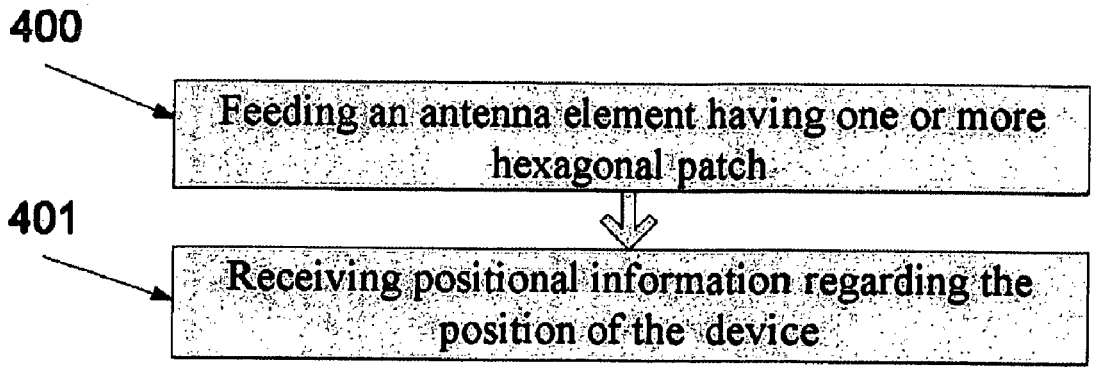
FIG. 8 is a simplified flowchart diagram of a method for using a microstrip antenna having a hexagonal patch for radiating electromagnetic energy over a wide predetermined frequency range, according to a preferred embodiment of the present invention.

Reference is now made to FIG. 8, which is a flowchart of an exemplary method, according to a preferred embodiment of the present invention, for radiating electromagnetic energy over a wide predetermined frequency range. During the first step, as shown at 400, an antenna element having one or more hexagonal patches is fed with transmission signals. The antenna element comprises a dielectric substrate, a signal feed element, and an electrically conductive ground plane which is coupled to the bottom of the dielectric substrate. As described above, one or more electrically conductive hexagonal patch elements are coupled to the upper side of the dielectric substrate. Each one of the electrically conductive antenna elements has a convex hexagonal shape with three approximately right angles and three wide angles. Each wide angle is positioned opposite a right angle. Each one of the wide angles measures approximately 150 degrees and each one of the right angles measures approximately 90 degrees. Each wide angle is positioned in between two right angles. The signal feed element is connected to a receiver, a transmitter or both. During step 401, the signal feed element receives positional information regarding the position of the device.

It is expected that during the life of this patent many relevant devices and systems will be developed and the scope of the terms herein, particularly of the term "dielectric substrate" is intended to include all such new technologies *a priori*.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

Reference is now made to the following examples, which together with the above descriptions illustrates the invention in a non-limiting fashion.

Figure 6A:
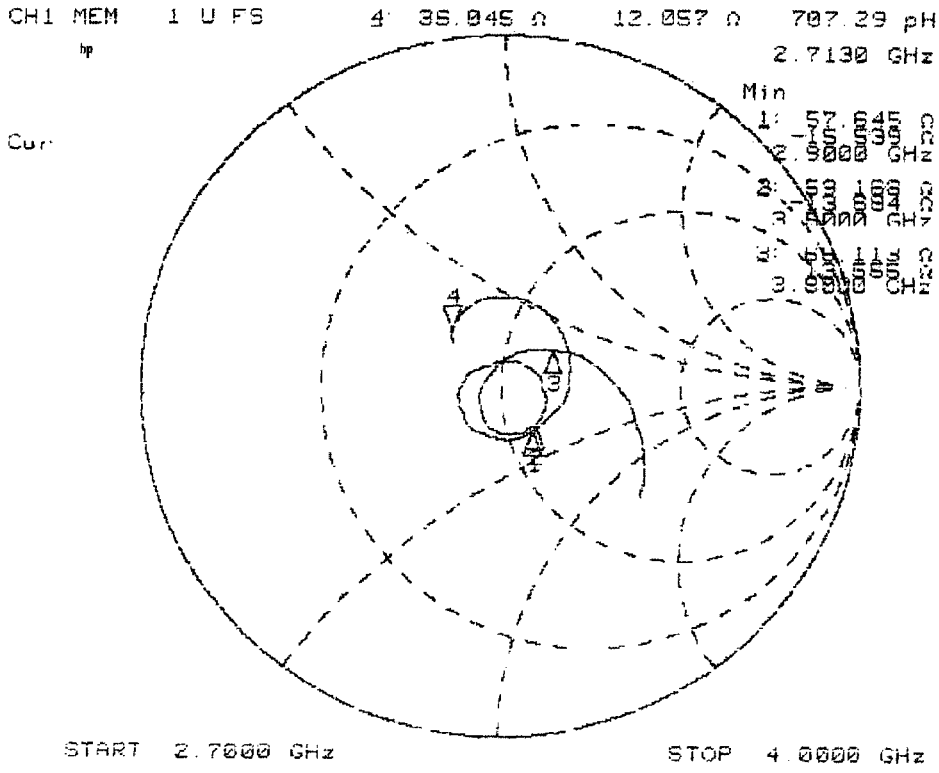
FIGS. 6A, 6B and 6C are Smith charts showing the performance under different conditions of antenna elements having different structures, according to embodiments of the present invention.
Figure 6B:
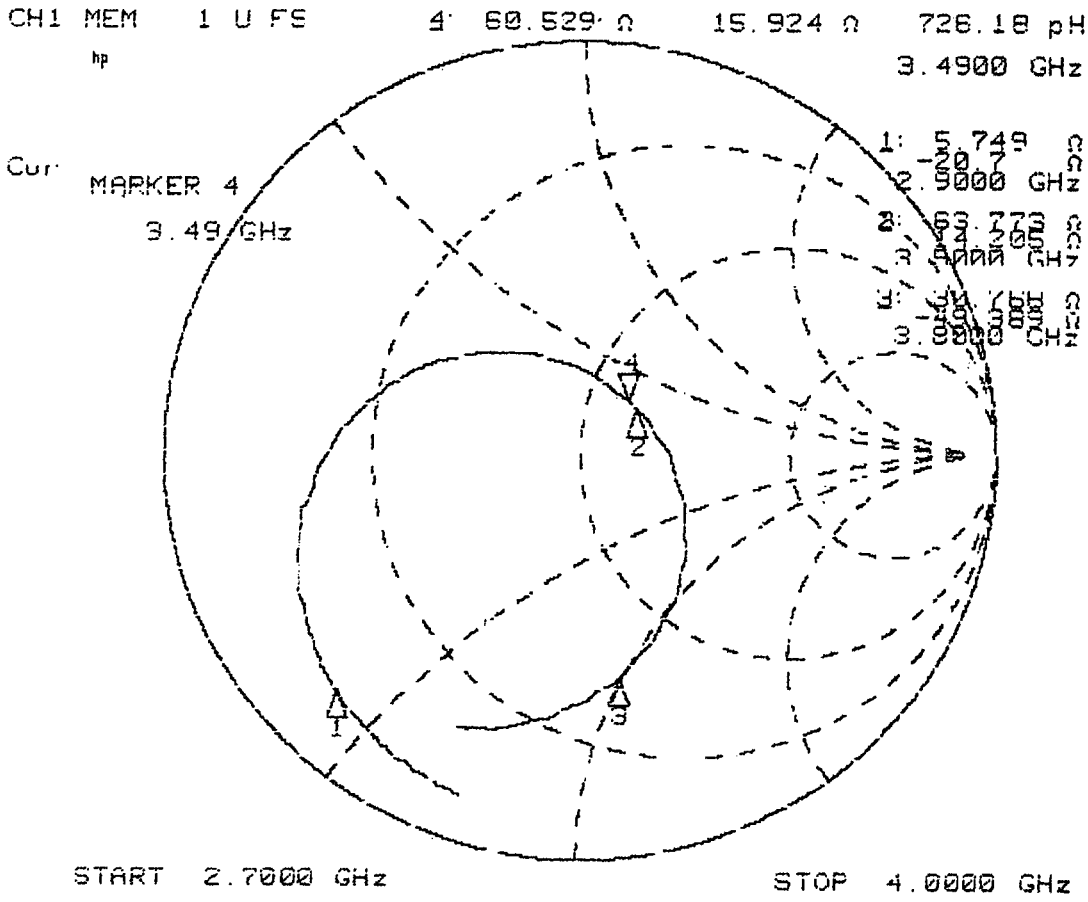
Figure 6C:
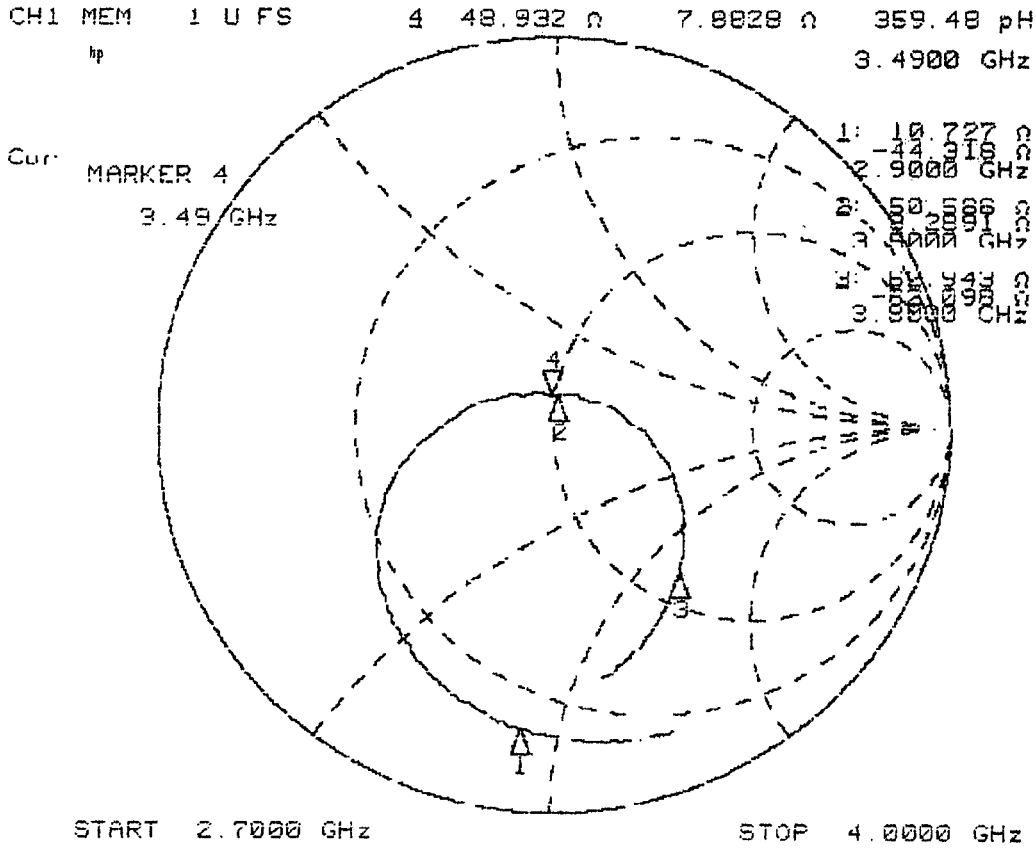

FIGS. 6A, 6B, and 6C show experimental data to illustrate one of the main advantages provided by the microstrip antenna according to the present embodiments, the advantage being the ability to maintain a high antenna gain level over a wide range of frequencies. FIG. 6A is a Smith diagram which is related to a microstrip antenna having a set of 4 patches and FIG. 6B is a Smith diagram which relates to a microstrip antenna having one patch. FIG. 6C is a Smith diagram which is related to a comparative microstrip antenna having a classical square patch having a surface area which is approximately similar to that of the microstrip antenna of the present embodiments. All the used hexagonal patches are approximately equilateral. Smith diagrams are familiar tools within the art and are thoroughly described in the literature, for instance in chapters 2.2 and 2.3 of "Microwave Transistor Amplifiers, Analysis and Design" by Guillermo Gonzales, Ph.D.; Prentice-Hall, Inc.; Englewood Cliffs, N.J. 07632, USA; ISBN 0-13-581646-7. Reference is also made to "Antenna Theory—Analysis and Design"; Balanis Constantine; John Wiley & Sons, Inc.; ISBN 0471606391, pages 43-46, 57-59. Both of these books are fully incorporated herein by reference- and, therefore, the nature of Smith diagrams is not discussed here in detail. However, in brief, the Smith diagrams in this specification illustrate the input impedance of the antenna: Z=R+jX, where R denotes the resistance, X denotes the reactance, and j denotes an operator which, when multiplied, advances the phase of a wave motion (phasor) through an angle of 90°.

If the reactance X>0, it is referred to as inductance; otherwise it is referred to as capacitance. In the diagrams of FIGS. 6A, 6B, and 6C, the values at four different frequencies are indicated as markers 1-4.

As depicted in the Smith diagrams of FIGS. 6A and 6B, the efficiency factor reflects antenna gain levels which remain relatively high over a wide range of frequencies. The Smith diagrams reflect the gain levels over frequencies between 2.7 GHz and 4.0 GHz.

Figure 7A:
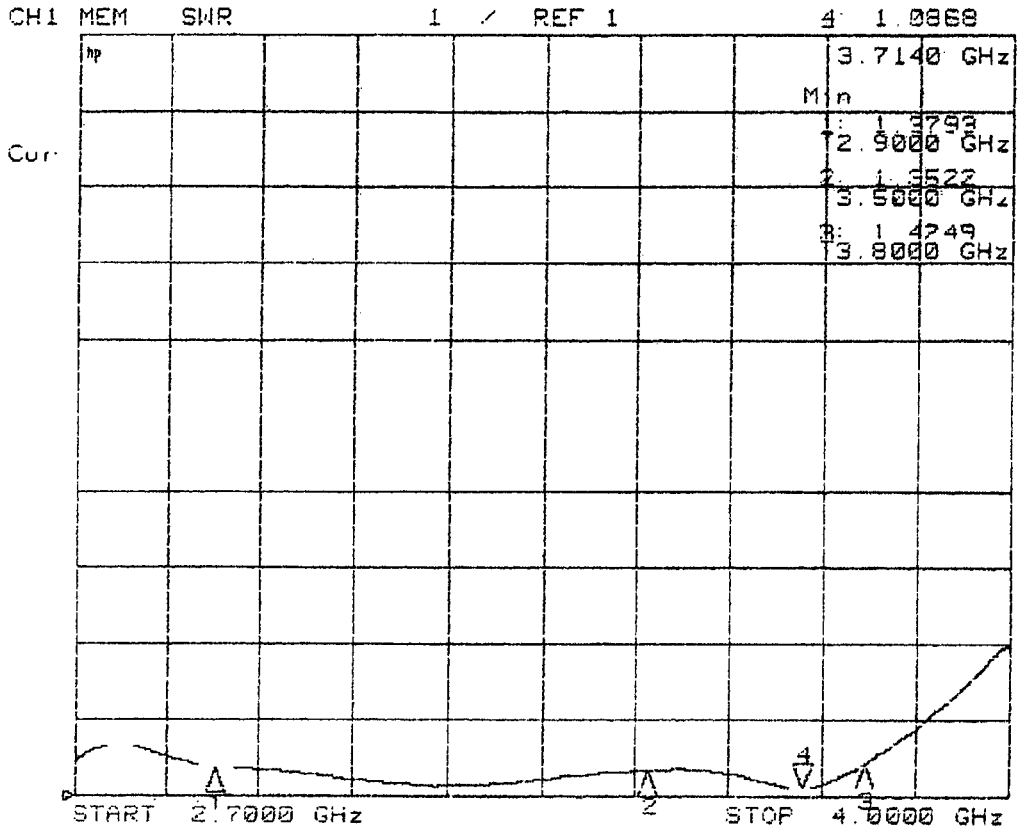
FIGS. 7A, 7B and 7C are standing wave radio (SWR) diagrams showing the performance under various conditions of antenna elements having different structures, according to embodiments of the present invention.
Figure 7B:
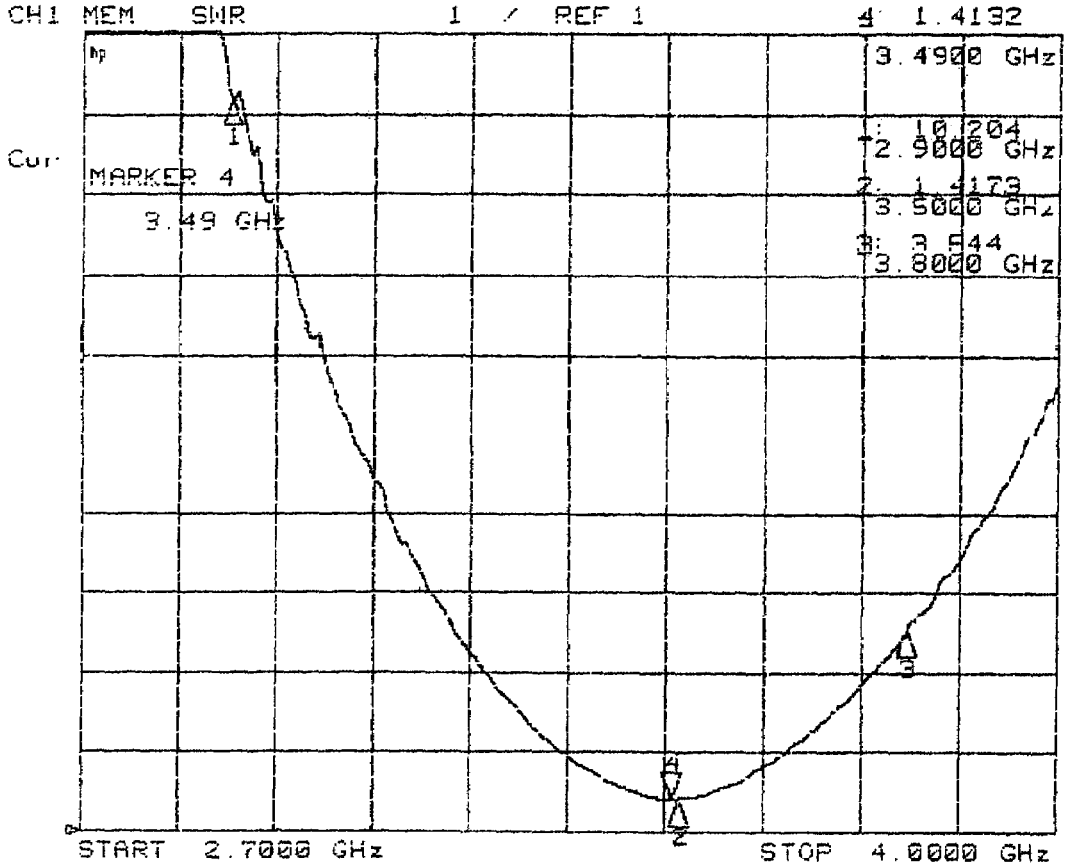
Figure 7C:
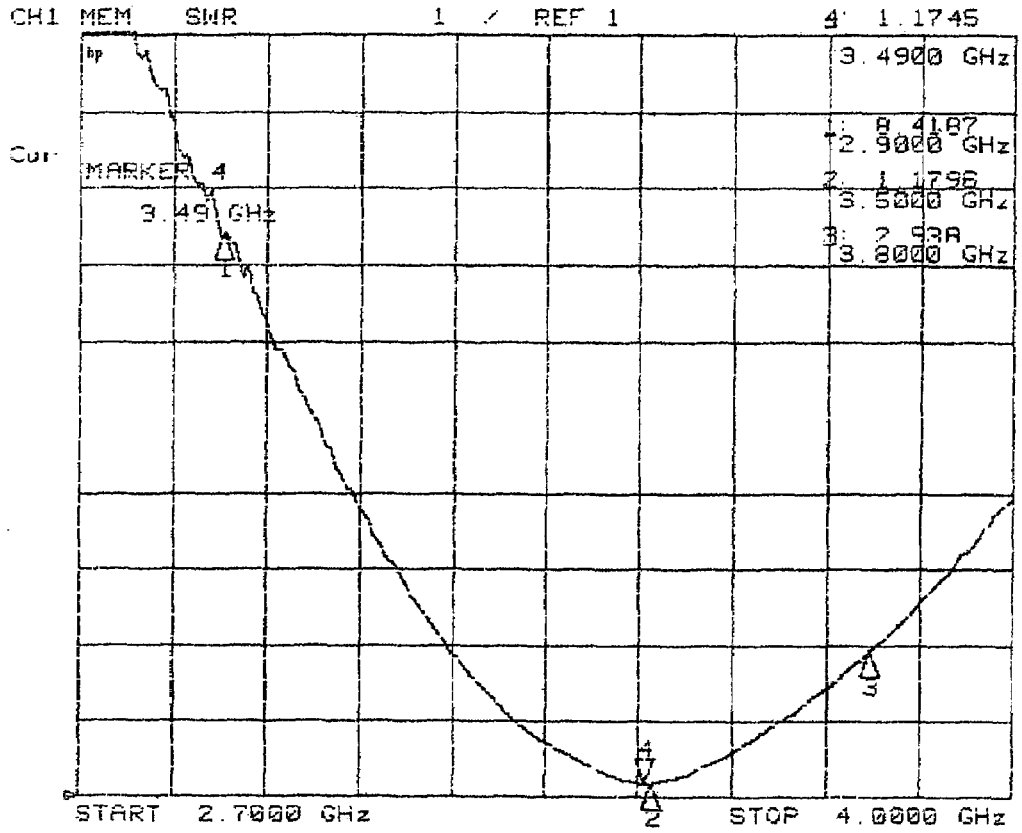

FIGS. 7A and 7B illustrate standing wave ratio (SWR) diagrams for a single patch microstrip between a four patch microstrip and a single patch microstrip, respectively, when kept in free space. FIG. 7C is a SWR diagram which is related to a comparative microstrip antenna having a classical square patch. All the used hexagonal patches are approximately equilateral.

SWR is defined as the ratio between maximum voltage or current and minimum voltage or current. In the diagrams of FIGS. 7A, 7B and 7C, the values at four different frequencies are indicated as markers 1-4.

The SWR diagram in FIG. 7A exhibits a very broad resonance cavity in between 2.9 GHz and 3.8 GHz, covering important frequency bands. The SWR diagram in FIG. 7B exhibits a very broad resonance cavity at approximately 3.5 GHz.

Of course, it should also be understood that the resonant dimensions may be defined by the size and position of the hexagonal patches as depicted in the embodiment of FIG. 1 and by the combination or permutation of the hexagonal patches as depicted in the embodiment of FIG. 5. Furthermore, other shape altering techniques for controlling the relative resonant dimensions will also occur to those skilled in the art upon consideration of the above-described embodiments of this invention.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An electrically conductive hexagonal patch element for a patch antenna, said hexagonal patch element comprising a convex hexagonal shape with a first angle and a second angle opposite said first angle, a third angle and a fourth angle opposite said third angle, a fifth angle and a sixth angle opposite said fifth angle, said first, third, and fifth angles each measuring approximately 150 degrees and said second, forth, and sixth angles, each measuring approximately 90 degrees, wherein said first angle is positioned in between said fourth angle and said sixth angle.

2. The electrically conductive hexagonal patch element of claim 1, wherein the sides of said hexagonal patch are approximately equal.

3. The electrically conductive hexagonal patch element of claim 1, wherein the apexes of said angles are configured as at least one of the following shapes: a rounded angle, an elongated angle, an arched angle, a concave angle, and a truncated angle.

4. The electrically conductive hexagonal patch element of claim 3 wherein an oblong slot is formed within said hexagonal patch element.

5. The electrically conductive hexagonal patch element of claim 1, wherein said angles are set with deviations not exceeding 5 percent.

6. A microstrip antenna having at least one electrically conductive hexagonal patch element, said microstrip antenna comprising a first dielectric substrate having an obverse and a reverse side;

an electrically conductive round plane adapted to be coupled to said reverse side;

at least one electrically conductive hexagonal patch element adapted to be coupled to said obverse side of said first dielectric substrate, said electrically conductive hexagonal patch element having a convex hexagonal shape with a first angle and a second angle opposite said first angle, a third angle and a fourth angle opposite said third angle, a fifth angle and a sixth angle opposite said fifth angle, said first, third, and fifth angles each measuring approximately 150 degrees and said second, forth, and sixth angles each measuring approximately 90 degrees, wherein said first angle is positioned in between said fourth angle and said sixth angle; and a signal feed element.

7. The microstrip antenna of claim 6, wherein the sides of at least one electrically conductive hexagonal patch are approximately equal.

8. The microstrip antenna of claim 6, further including a radio frequency power source coupled to said signal feed element for causing said antenna element to emit an electromagnetic radiation energy pattern.

9. The microstrip antenna of claim 6, wherein the apexes of said angles are configured as at least one of the following shapes: a rounded angle, an elongated angle, an arched angle, a concave angle, and a truncated angle.

10. The electrically conductive hexagonal patch element of claim 9 wherein an oblong slot is formed within said at least one electrically conductive hexagonal patch.

11. The microstrip antenna of claim 6 wherein said angles are set with deviations not exceeding 5 percent.

12. The microstrip antenna of claim 6, said at least one electrically conductive hexagonal patch element having a surface area equal to the outcome of a function of a transmitted radiation wavelength of said microstrip antenna, and a dielectric permeability of said first dielectric substrate to the radiation.

13. The microstrip antenna of claim 6, further comprising a second dielectric substrate.

14. The microstrip antenna of claim 13, wherein said second dielectric substrate is positioned in between said first dielectric substrate and said electrically conductive ground plane, wherein a portion of said signal feed element is positioned in between said first and second dielectric substrates.

15. The microstrip antenna of claim 13, wherein said second dielectric substrate is coupled to the bottom of said electrically conductive ground plane, said electrically conductive ground plane having at least one aperture, wherein a portion of said signal feed element is positioned in between said second dielectric substrate and said electrically conductive ground plane.

16. The microstrip antenna of claim 6, wherein said signal feed element is directly connected to said electrically conductive hexagonal patch element.

17. The microstrip antenna of claim 16, wherein said direct connection to said hexagonal patch element is via said second, fourth, and sixth angles in order to achieve direct polarization.

18. The microstrip antenna of claim 6, wherein said second angle is truncated to form an additional side, said additional side being parallel to the central transverse axis of said at least one electrically conductive hexagonal patch, said signal feed element being positioned in parallel to said additional side.

19. The microstrip antenna of claim 6, wherein said signal feed element is used to physically raise up said at least one electrically conductive hexagonal patch element to define an airgap thereunder.

20. The microstrip antenna of claim 6, said at least one electrically conductive hexagonal patch element comprising at least two electrically conductive hexagonal patch elements, said microstrip antenna further comprising a patch connector, said patch connector configured to interconnect between said at least two electrically conductive hexagonal patch elements.

21. The microstrip antenna of claim 6, wherein said first dielectric substrate is fabricated of a material of at least one of the following group: a cured fiber reinforced resin epoxy glass fabric and fiber glass.

22. The microstrip antenna of claim 6, wherein said at least one electrically conductive hexagonal patch element is configured to be positioned in parallel and proximal to said obverse side of said dielectric substrate.

23. A method of radiating electromagnetic energy over a wide predetermined frequency range, said method comprising the steps of:

(a) feeding an antenna element with transmission signals, said antenna element comprising:

first dielectric substrate having an obverse, and a reverse side, an electrically conductive ground plane adapted to be coupled to said reverse side, at least one electrically conductive hexagonal patch element adapted to be coupled to said obverse side of said first dielectric substrate, said electrically conductive hexagonal patch element having a convex hexagonal shape with a first angle and a second angle opposite said first angle, a third angle and a fourth angle opposite said third angle, a fifth angle and a sixth angle opposite said fifth angle, said first, third, and fifth angles each measuring approximately 150 degrees and said second, forth, and sixth angles each measuring approximately 90 degrees, wherein said first angle is positioned in between said fourth angle and said sixth angle, and a signal feed element; and (b) connecting said signal feed element to a signal conveyor.

24. The method of radiating electromagnetic energy of claim 23, said at least one electrically conductive hexagonal patch element having a surface area equal to the outcome of a function of a transmitted radiation wavelength of said antenna element, and a dielectric permeability of said first dielectric substrate to the radiation.

* * * * *